United States Patent [19]

Hall

[11] 4,184,412

[45] Jan. 22, 1980

[54] POCKET-TYPE CHARCOAL FILTER AND CIGARETTE MADE THEREWITH

[75] Inventor: Floyd V. Hall, Durham, N.C.

[73] Assignee: Liggett Group Inc., Montvale, N.J.

[21] Appl. No.: 888,265

[22] Filed: Mar. 20, 1978

Related U.S. Application Data

[62] Division of Ser. No. 779,026, Mar. 18, 1977.

[51] Int. Cl.[2] ..... A24C 5/50

[52] U.S. Cl. ..... 93/1 C

[58] Field of Search ..... 93/1 C, 77 FT; 131/261 B, 10.7, 10.5

[56] References Cited

U.S. PATENT DOCUMENTS

| | | | |
|---|---|---|---|
| 3,259,029 | 7/1966 | Hall et al. | 131/10.7 X |
| 3,473,539 | 10/1969 | Sexstone et al. | 93/1 C X |
| 3,844,200 | 10/1974 | Sexstone | 131/261 B X |
| 3,911,797 | 10/1975 | Kastner | 93/1 C |

*Primary Examiner*—James F. Coan

*Attorney, Agent, or Firm*—J. Bowen Ross, Jr.

[57] ABSTRACT

The apparatus for making the filter forms a stream of tow into a U-shaped trough so that charges of charcoal can be injected into the trough by a charcoal wheel. The shape of the tow is ensured by feeding the tow into a funnel-shaped passageway from below the level of the passageway, the tow remains U-shaped without the need of any other means.

18 Claims, 5 Drawing Figures

50MM
150MM
34MM
16MM
A
B
L

POCKET-TYPE CHARCOAL FILTER AND CIGARETTE MADE THEREWITH

This is a division of application Ser. No. 779,026, filed Mar. 18, 1977.

This invention relates to a filter for cigarettes. More particularly, this invention relates to a pocket-type filter for an air dilution-type cigarette, the cigarette made therewith and the method and apparatus for making the filter.

Heretofore, various types of filters for filter cigarettes have been known. In some cases, the filter has been formed of a single section of entrainment-type filter material such as cellulose acetate, commonly referred to as tow and placed at the end of a tobacco column to filter a stream of smoke drawn through the filter body during smoking. In other cases, the filters have been made of multi-sectional construction in order to combine the filtering action of two different types of filtering media in one filter. For example, one known type of filter has a chamber of particulate material, such as charcoal, positioned between two sections of fibrous filter material, such as tow. In this case, the smoke from a cigarette is first filtered in one fibrous filter section, thereafter filtered in the charcoal containing section and, then, filtered in the remaining fibrous filter section.

Still further, other filters have been known wherein air is drawn in from the outside in order to dilute the smoke prior to or coincident with passage into a smoker's mouth. In such cases, perforations have usually been provided in the outer wrapping of tipping paper which joins the filter to a tobacco column so as to permit air to be drawn into the filter. In the case where air is drawn directly into the filter, the filter media are generally wrapped in a porous plug wrap paper; the porosity of which permits the air to pass into the body of the filter.

Along with the various known filters, there are a number of known techniques for manufacturing these filters. For example, in the case of the multi-sectional filters, use has been made of charcoal wheels for depositing charges of charcoal between spaced apart plugs of fibrous filter material, such as described in U.S. Pat. Nos. 3,356,321 and 3,259,029. It has also been known to deposit granules of filter material directly into a continuously moving stream of fibrous filter material. In such cases, individual charges of particulate filter material can be deposited on the fibrous filter material stream and the fibrous stream thereafter rolled into a cylinder and wrapped with plug wrap paper. Also, the fibrous filter material stream may be shaped into a U-shape by being passed through a U-shaped passageway defined, for example by a trumpet and rib structure as described in U.S. Pat. No. 3,844,200. Suction may also be applied beneath the tow by a vacuum source to expedite transfer of the granules into the travelling U-shaped web of fibrous filter material. Still other techniques are known wherein a preformed fibrous filter rod is split in half and folded out to receive charges of particulate material and thereafter folded back into a cylindrical shape.

However, where particulate material is deposited in equi-spaced manner into a U-shaped web or onto a continuously moving stream of fibrous filter material, the particulate material can show leakage to both ends of the resultant filter. This is objectionable for a number of reasons. First, the particulate material may not efficiently filter the smoke passing through the filter, particularly the particulate material at the smoker's end of the filter. Second, the appearance of the particulate material in the exposed end of the filter is not aesthetically pleasing. This also requires monitoring by expensive equipment to detect and remove filters or cigarettes which have, as "faults", exposed particles of particulate material. Third, pieces of the particulate material may enter the smoker's mouth during smoking if exposed at the end of the cigarette.

In addition, where the pocket-type filters are used in air dilution-type cigarettes, there are further disadvantages. Because of the need to space the air perforations in the tipping paper away from the smoker's mouth in order to avoid covering over by a smoker's lips, the air perforations have generally been located slightly more than half the length of the filter from the exposed end of the filter. As a result, the perforations are aligned with the pocket of particulate material within the filter. Thus, when air enters into the filter body, the air tends to flow into the particulate material with the smoke and mix with the smoke within the pocket. This, in turn, reduces the efficiency of the filtering action of the particulate material.

Accordingly, it is an object of the invention to provide a pocket-type filter which does not leak particulate material to the exposed end of the filter on a cigarette.

It is another object of the invention to provide a pocket-type filter wherein the particulate material is closer to the tobacco end of the filter than to the end to be exposed.

It is another object of the invention to provide an air dilution-type filter cigarette wherein smoke is filtered by a pocket of particulate filter material before being mixed with air.

It is another object of the invention to increase the efficiency of the filters used in high air dilution-type filter cigarettes.

It is another object of the invention to provide a simple technique for making filters with pockets of particulate filter material therein.

It is another object of the invention to provide an apparatus for making pocket-type filters which utilizes a minimum of parts.

Briefly, the invention provides a filter which is composed of an elongated cylindrical body of fibrous entrainment-type filter material, a charge of particulate filter material enveloped within the body and a layer of plug wrap paper about the body and wherein the charge of particulate material is closer to one end of the filter than to the other end. That is, the charge is disposed on a transverse centerline which is spaced a greater distance from one end of the filter body (i.e. the exposed end) than from the opposite end (i.e. the tobacco end) while also being disposed radially within the body (i.e. in spaced relation to the circumference of the filter body). In one particular embodiment, the fibrous filter material is made of cellulose-acetate, commonly referred to as tow, while the particulate material is charcoal.

The invention further provides a filter cigarette which is comprised of a tobacco column, a filter as described above and a layer of tipping paper which joins the tobacco column to the filter. Where the cigarette is of the air dilution-type, the tipping paper has an annular array of apertures for admitting air into the filter body while the plug wrap paper is porous so as to permit air to pass through. In addition, the annular array of apertures is disposed closer to the exposed end of the filter than the transverse centerline of the charge of particulate filter material. In this way, the air which enters into the filter body via the apertures, enters at a point downstream of the main body of the particulate material. As a result, during smoking, the smoke first passes through the particulate material by following the path of least resistance before being mixed with the air.

The invention further provides a method and apparatus for making the above filters.

The method includes the steps of passing a web of fibrous entrainment-type filter material into and through a funnel-shaped passageway from below the level of the passageway in order to form the web into a U-shaped trough and of thereafter injecting a sequence of charges of particulate material into the trough in spaced apart manner. In order to effect the spatial relationship of the charges of particulate material in the final filters, the charges are injected into the unsupported trough of fibrous filter material in an alternating pattern of unequal spacing. After injection, the fibrous filter material is enveloped about the injected charges and is supplied with a strip of plug wrap paper which is then wrapped about the filter materials to form an endless rod. The plug wrap paper overlaps itself slightly and the entire rod is sealed at the overlap. This rod is then processed by being severed between a pair of closely spaced charges to form filter plugs, for example, of a length sufficient to produce six filters. Each of these plugs is thereafter severed between a pair of closely spaced charges to form a two-filter filter plug having a pair of remotely spaced charges therein. Each of these latter plugs are then joined to two tobacco columns in known fashion and severed in the middle between the two remotely spaced particulate charges. The resultant filter cigarettes thus have a filter in which the charge of particulate material is closer to the tobacco column than to the exposed end of the cigarette.

The apparatus includes a means, such as a rotatable wheel, having a plurality of circumferentially spaced chambers for receiving individual charges of particulate filter material; means for sequentially ejecting each charge from a chamber; a means defining a funnel-shaped passageway below the wheel; means for maintaining the tow under tension; and a means for moving a web of plasticized fibrous material into the passageway from below the level of the passageway. By introducing the web into the passageway from below under tension, the web is pressed against the lower internal wall of the passageway to form a U-shaped trough. The web can then be moved below the wheel to receive while unsupported a sequence of individual charges of particulate material within the trough. By feeding the web from beneath the U-shaped funnel under tension no additional components are required in order to maintain the U-shape of the trough for the tow assumes the lower internal shape of the passageway. The injecting wheel can be constructed so as to inject single charges into the trough of fibrous material or can be constructed to inject pairs of charges into the trough of the fibrous material.

The apparatus also includes a means for conveying a strip of plug wrap paper under the tow of fibrous filter material and a garniture section downstream of the wheel for wrapping and sealing the strip of plug wrap paper about the fibrous filter material and injected particulate charges in order to form an endless rod in known manner.

These and other objects and advantages of the invention will become more apparent from the following detailed description and appended claims taken in conjunction with the accompanying drawings in which:

Figure 1:
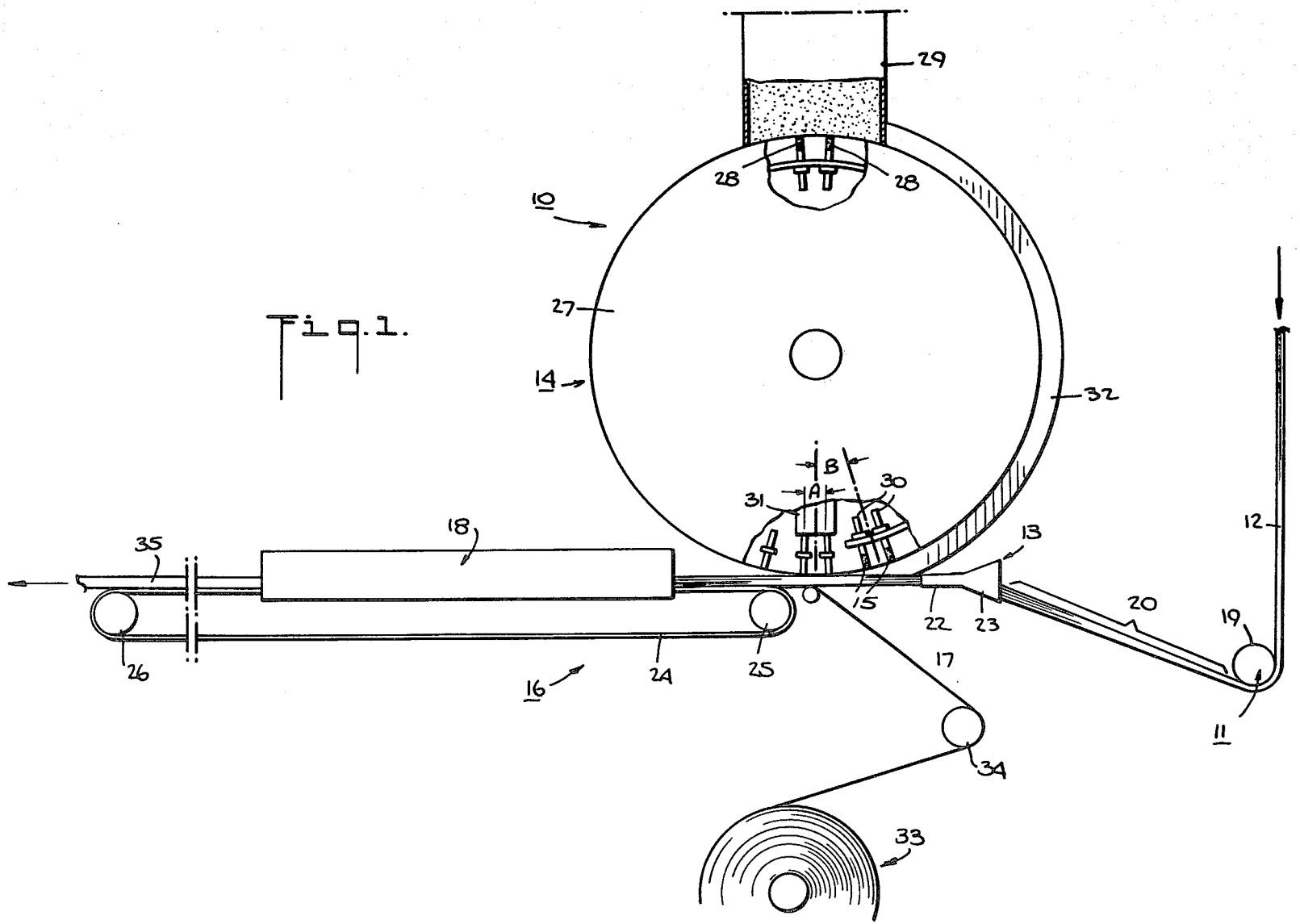
FIG. 1 illustrates a schematic side view of an apparatus in accordance with the invention.

Referring to FIG. 1, the apparatus 10 has a means 11 for moving a tow 12 of plasticized fibrous filter material under tension from a suitable supply (not shown) through a predetermined path; a means 13 defining a funnel-shaped passageway for shaping the tow 12 into a U-shaped trough (see FIG. 2); a means 14 for injecting a sequence of charges 15 of particulate material into the U-shaped trough while unsupported; and a means 16 for conveying a strip 17 of plug wrap paper under the tow 12 and a garniture section 18.

The means 11 for moving the tow 12 employs at least one guide roll 19 about which the tow 12 is directed into an upwardly inclined path portion 20.

Figures 2, 3, 4, 5:
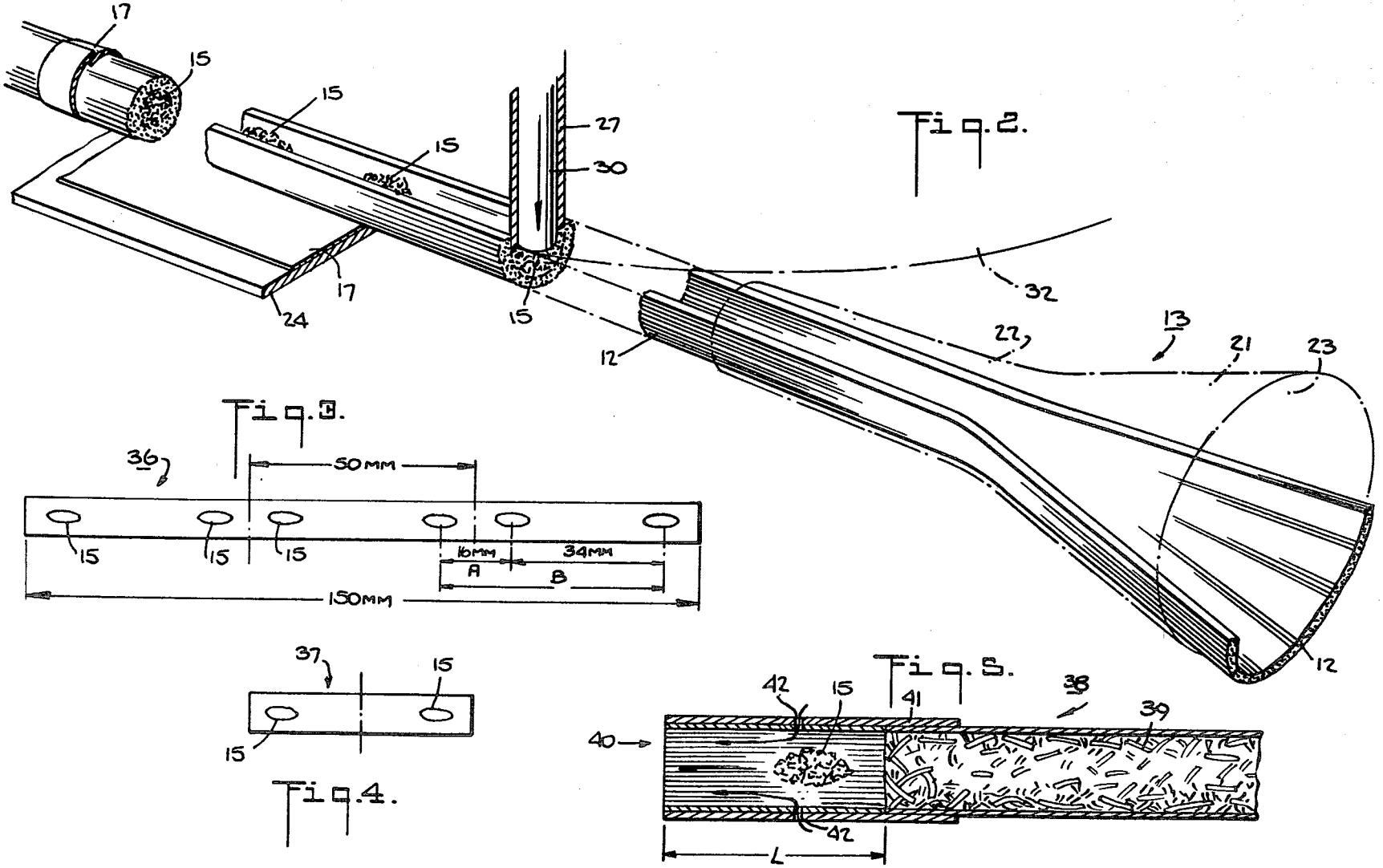
FIG. 2 illustrates a schematic view of the components of the apparatus for shaping a fibrous filter web into a U-shaped trough and for injecting particulate material into the U-shaped trough.
FIG. 3 illustrates a filter plug severed from an endless rod made by the apparatus of FIG. 1.
FIG. 4 illustrates a dual filter plug severed from the filter plug of FIG. 3.
FIG. 5 illustrates a partial view in section of a cigarette made in accordance with the invention.

As shown in FIG. 2, the means 13 forming the funnel-shaped passageway is a funnel having a conical portion 21 at a forward end and a cylindrical portion 22 at a rearmost end. The interior wall 23 of the funnel 13 is continuous from the conical portion 21 into the cylindrical portion 23. As shown in FIG. 1, the funnel 13 is disposed horizontally and projects into the path of the tow 12. As a result, the tow 12 deflects about the edge of the funnel 13 when entering the conical portion 23. In addition, the tow 12 spreads out across the wall 23 of the conical portion 23 and thereby takes on a rounded shape similar to the wall 23. Upon passing into the cylindrical portion 22, the tow 12 takes on a more pronounced U-shape due to the narrowing of the funnel 13. Thus, upon passing out of the funnel 13, the tow 12 forms a U-shaped trough.

Referring to FIG. 1, the conveyor 16 is of conventional structure and has a ribbon or endless belt 24 which is guided and driven over suitable driving guide rolls 25, 26. The upstream end of the conveyor 16 is positioned immediately downstream of tow 12 receiving the granular material from injecting means 14.

The injecting means 14 is positioned for injecting the charges 15 of particulate material, such as charcoal, into the U-shaped trough of the tow 12. The injecting means 14 is, for example, in the form of a rotatable charcoal wheel 27 having a plurality of peripherally spaced chambers 28 for receiving charcoal from a supply hopper 29 above the wheel 27. In addition, suitable plungers 30 are slidably mounted in the chambers 28 for expelling the charges 15 of charcoal at a lowermost position of the wheel 27. To this end, the wheel 27 has a means in the form of a reciprocating hammer 31 at the lower portion for sequentially injecting a pair of charges 15 of charcoal. As is known, such a hammer 31 is sized and timed to push two plungers 30 into their respective recesses 28 to expel a pair of charges 25. Alternatively, the hammer 31 may be sized and timed to eject only one charge at a time into the U-shaped web 12.

As shown in FIG. 1, a shroud 32 is positioned about a part of the periphery of the rotatable charcoal wheel 27 so as to retain the charges 15 of charcoal within the chambers 28 until the charges 15 are to be ejected. To this end, the shroud 32 extends down to a point near the lowermost position of the charcoal wheel 27.

Means 16 for conveying the strip 17 of plug wrap paper includes a supply roll 33 of plug wrap paper which is rotatably mounted on the apparatus in known fashion as well as one or more guide rollers 34 for guiding the strip 17 onto the conveyor belt 24 at a point immediately downstream of the charcoal wheel 27. Thus, the conveyor 16 serves to convey the strip 17 of plug wrap paper and tow 12 containing charges 15 through the garniture section 18. The plug wrap paper is of a porous nature so as to permit air to flow through as explained below.

Referring to FIG. 1, the garniture section 18 is of conventional structure and is disposed downstream of the charcoal wheel 24 for wrapping and sealing the strip 17 of plug wrap paper about the tow 12 and the injected charges 15 of charcoal in order to form an endless rod 35.

Referring to FIG. 1, the chambers 28 of the charcoal wheel 27 are spaced so that the charges 15 are disposed in an alternating sequence of unequal spacings. That is, the charges of each pair of injected charges 15 are spaced at a distance A from centerline-to-centerline less than the distance B from centerline-to-centerline of one injected pair of charges to the next pair of charges 15. For example, charges 15 in each pair of injected charges are spaced apart a distance A of 16 millimeters with the pairs of charges spaced from each other a distance B of 34 millimeters. This gives alternating centerline-to-centerline spacings of 16 and 34 millimeters.

Referring to FIG. 1, in operation, the tow 12 of fibrous filter material such as cellulose acetate is directed upwardly through the inclined path 20 to the funnel 13. Upon passing into the funnel 13, the web 12 is deflected due to the tension in the web 12 between the guide roller 19 and the outlet end of the funnel 13. The web 12 thus conforms to the shape of the internal wall 23 of the funnel 13 (FIG. 2) and upon passing through the cylindrical funnel portion 22 is formed into a U-shaped trough. Upon passing from the funnel 13, the U-shaped tow 12 passes directly under the lowermost position of the charcoal wheel 27. A pair of charges 15 of charcoal are then injected into the U-shaped web 12 by the charcoal wheel 27 with the plungers 30 holding the charge in place in U-shaped tow 12. This ensures that the charges 15 are fully injected into the tow 12. The injected charges 15 thus take on an egg-shaped form in the tow 12.

Thereafter, the U-shaped tow 12 and injected charges 15 are passed into the garniture section 18 (FIG. 1) wherein the legs of the U-shaped tow 12 are brought together and the plug wrap paper strip 17 folded over the tow 12 and injected charges 15 to form the endless rod 35 in known manner. During this time, the ends of the U-shaped tow 12 are matted together without forming a seam within the rod 35. In addition, the charges 15 are completely enveloped by the tow such that pockets of charcoal are formed in the rod 35.

The endless rod 35 is thereafter severed by a suitable knife assembly (not shown), for example as described in U.S. Pat. No. 3,259,029, into filter plugs 36 (FIG. 3) of a length sufficient to form six filters. As shown in FIG. 3, these filter plugs 36 are obtained by severing the endless rod 35 at points between a pair of closely spaced charges 15. These filter plugs 36 are then cut between the closely spaced charges 15 into dual filter plugs 37 (FIG. 4) in known manner and delivered to a cigarette making machine (not shown). As shown in FIG. 4, each of the dual filter plugs 37 contains a pair of charges 15 which are remotely spaced from each other relative to the closely spaced charges 15 initially injected into the endless rod 35. Thereafter, two tobacco columns are then joined to the dual filter plug 37 in the cigarette making machine and a strip of tipping paper wrapped about the plug and tobacco columns to secure the columns to the filter plug 37. The plug 37 is then cut in the middle to form two cigarettes.

As shown in FIG. 5, the resultant cigarette 38 includes a tobacco column 39, a filter 40 and a strip of tipping paper 41 joining the filter 40 to the tobacco column 39. The filter 40 has a charge or pocket 15 of charcoal spaced closer to the tobacco column 39 than to the exposed end of the cigarette 38. For example, for a filter length L of 25 millimeters, the centerline of the charge 15 is spaced from the exposed end of the cigarette a distance of 17 millimeters. In addition, the tipping paper 41 is provided with a circular array of holes 42 in order to allow air to be drawn into the filter 40 during smoking. The centerline of this circular array of holes 42 is spaced from the exposed end of the cigarette 38 by a distance of between 14 and 15 millimeters. Thus, as air is drawn into the filter 40, during smoking, the air substantially bypasses the pocket 15 of charcoal. As a result, the smoke is first filtered by the charcoal before being mixed with air. In this regard, it is noted that the path of least resistance for the smoke flow extends from the tobacco column 39 into the pocket of charcoal since the filter fibers comprising tow 12 are compacted in the area adjacent pocket 15 due to the presence of the granular material comprising the pocket thus causing flow through the porous pocket 15.

The invention thus provides a cigarette filter of pocket type wherein a charge of particulate material, such a charcoal, is positioned closer to the tobacco column end than to the exposed end. As a result, leakage of the particulate material to the exposed end is reduced to a minimum if not eliminated. Further, when used in an air dilution-type cigarette, the smoke from the tobacco column can be filtered by the particulate material before being mixed with the air which is drawn into the filter. As a result, the filtering efficiency of the particulate material is enhanced.

The invention further provides a simplified apparatus for shaping a continuous length of tow into a U-shape for receiving spaced apart charges of particulate material. In this case, only a relatively few number of components are required, i.e. a funnel shaped passageway and guide rollers for guiding the stream of tow into the passageway from below under a sufficient tension to cause the web to conform to the wall of the passageway and thus form a U-shaped trough.

What is claimed is:

1. A method of making filters for cigarettes comprising the steps of moving a tow of plasticized fibrous filter material through a predetermined path;

passing the tow of fibrous filter material into a funnel-shaped passageway from below the level of the passageway to press the web against the lower wall of the passageway to form a U-shaped trough;

injecting a sequence of charges of particulate filter material into the U-shaped trough downstream of the passageway in spaced apart manner;

thereafter enveloping the fibrous filter material about the injected charges; and wrapping and sealing a strip of plug wrap paper about the fibrous filter material and enveloped charges of particulate filter material to form an endless rod.

2. A method as set forth in claim 1 wherein said step of injecting includes a simultaneous injection of a pair of said charges into the U-shaped trough of fibrous filter material.

3. A method as set forth in claim 2 wherein said pair of charges are spaced apart a distance of sixteen millimeters from centerline-to-centerline.

4. A method as set forth in claim 3 wherein each said pair of charges is spaced from an adjacent pair of charges a distance of fifty millimeters.

5. A method as set forth in claim 1 wherein each charge is injected into the U-shaped trough to form an egg-shaped charge therein.

6. A method as set forth in claim 1 wherein the charges are injected into the U-shaped trough in an alternating pattern of unequal spacings and which further comprises the steps of severing the endless rod centrally between a pair of closely spaced charges to form at least one filter plug having a pair of remotely spaced charges therein.

7. A method as set forth in claim 6 which further comprises the step of severing a filter plug centrally between the pair of remotely spaced charges to form two filters, each filter having a single charge therein disposed closer to one end thereof than to the opposite end thereof.

8. A method as set forth in claim 1 wherein the plug wrap paper is porous to the passage of air.

9. In a method as set forth in claim 8 wherein the charges are injected into the U-shaped trough in an alternating pattern of unequal spacings and which further comprises the steps of enveloping the fibrous filter material about the injected charges; wrapping and sealing a strip of plug wrap paper about the fibrous filter material and enveloped charges of particulate filter material to form an endless rod; and severing the endless rod centrally between a pair of closely spaced charges to form at least one filter plug having a pair of remotely spaced charges therein.

10. In a method of making filters, the steps of passing a tow of fibrous entrainment-type filter material into and through a funnel-shaped passageway from below the level of the passageway to form the tow into a U-shaped trough; and thereafter injecting a sequence of charges of particulate filter material into the U-shaped trough in spaced apart manner.

11. An apparatus for making filters comprising means for moving a tow of plasticized fibrous filter material through a predetermined path having an upwardly inclined portion;

a means defining a funnel-shaped passageway disposed in said upwardly inclined portion of said path for shaping the tow of fibrous filter material into a U-shaped trough;

means downstream of said passageway for injecting a sequence of charges of particulate material into the U-shaped trough;

means for conveying a strip of plug wrap paper under the tow of fibrous filter material; and a garniture section downstream of said injecting means for wrapping and sealing the strip of plug wrap paper about the fibrous filter material and injected charges of particulate material to form an endless rod.

12. An apparatus as set forth in claim 11 wherein said injecting means is a rotatable charcoal wheel having peripherally spaced chambers for receiving charges of particulate material and means for sequentially injecting at least one charge of particulate filter material from said chambers into the U-shaped trough of fibrous filter material.

13. An apparatus as set forth in claim 12 wherein said injecting means includes a reciprocable hammer for sequentially injecting pairs of spaced apart charges of particulate filter material simultaneously into the U-shaped trough of fibrous filter material.

14. An apparatus as set forth in claim 13 wherein said charges of a pair of charges are spaced at a distance from centerline-to-centerline less than the distance between the centerline of one charge of said pair of charges and the centerline of the next adjacent charge of an adjacent pair of charges.

15. An apparatus as set forth in claim 13 wherein said pair of charges are spaced apart a distance of sixteen millimeters from centerline-to-centerline and each said pair of charges is spaced from an adjacent pair of charges a distance of fifty millimeters from centerline-to-centerline.

16. The combination as set forth in claim 15 which further comprises a conveyor for conveying a strip of plug wrap paper under the tow of fibrous filter material below said wheel, and a garniture section downstream of said wheel for wrapping and sealing the strip of plug wrap paper about the fibrous filter material and injected charges of particulate material to form an endless rod.

17. The combination as set forth in claim 16 wherein said means for moving the web of fibrous filter material includes a plurality of guide rolls for directing the tow of fibrous filter material into said passageway.

18. In an apparatus for making filters, the combination comprising a rotatable wheel having a plurality of circumferentially spaced chambers for receiving individual charges of particulate filter material and means for sequentially ejecting each charge from a respective chamber;

means defining a funnel-shaped passageway below said wheel; and means for moving a tow of plasticized fibrous filter material into said passageway from below the level of said passageway to press the web against the wall of said passageway to form a U-shaped trough while moving the U-shaped tow below said wheel to receive a sequence of individual charges of particulate material therefrom.

* * * * *